US005350142A

United States Patent [19]

Kurtzman et al.

[11] Patent Number: 5,350,142

[45] Date of Patent: Sep. 27, 1994

[54] SUPPORT FRAME FOR FLEXIBLE BAGS WITH HANDLES

[76] Inventors: Michael R. Kurtzman; Meehyun Kim, both of 840 California St. #57, San Francisco, Calif. 94108

[21] Appl. No.: 49,762

[22] Filed: Apr. 19, 1993

[51] Int. Cl.[5] ..... B65B 67/04

[52] U.S. Cl. ..... 248/99; 248/95

[58] Field of Search ..... 248/95, 97, 98, 99, 248/100, 101; 141/369, 370; 220/404, 908

[56] References Cited

U.S. PATENT DOCUMENTS

| | | | |
|---|---|---|---|
| 3,760,975 | 9/1973 | Gustav | 248/100 X |
| 3,870,261 | 3/1975 | McSwain | 248/101 |
| 3,893,648 | 7/1975 | Gilbert | 248/97 |
| 4,445,658 | 5/1984 | Ferron | 248/99 |
| 4,695,020 | 9/1987 | Collins | 248/95 X |
| 4,750,695 | 6/1988 | Greenhouse | 248/99 |
| 4,838,504 | 6/1989 | Bittenbinder | 248/100 |
| 4,923,087 | 5/1990 | Burrows | 220/404 |
| 4,957,252 | 9/1990 | Watkins | 248/97 |
| 5,100,087 | 3/1992 | Ashby | 220/404 X |
| 5,232,274 | 8/1993 | Johan | 248/101 X |

FOREIGN PATENT DOCUMENTS

| | | | |
|---|---|---|---|
| 2046694 | 11/1980 | United Kingdom | 248/95 |

*Primary Examiner*—J. Franklin Foss

[57] ABSTRACT

A structural frame providing for supporting flexible containers; specifically, shopping bags with frontal or lateral integrated handles. The structure enables the use of shopping bags as a receptacle for trash or storage. Disclosed are embodiments for a polygonal shaped rim for supporting a flexible handle bag in open mouthed configuration; lateral bracing to restrict bag movement; ring like members allowing bag handles to be engaged securely; a support appendage with an angled spacer allowing flexible container to be easily mounted on said support frame; a lid with a perimetrical groove of a radius corresponding to that of said rim located on the underside of said lid allowing for a tight seal; and an integrated apparatus for mounting the invention to a planar surface.

4 Claims, 11 Drawing Sheets

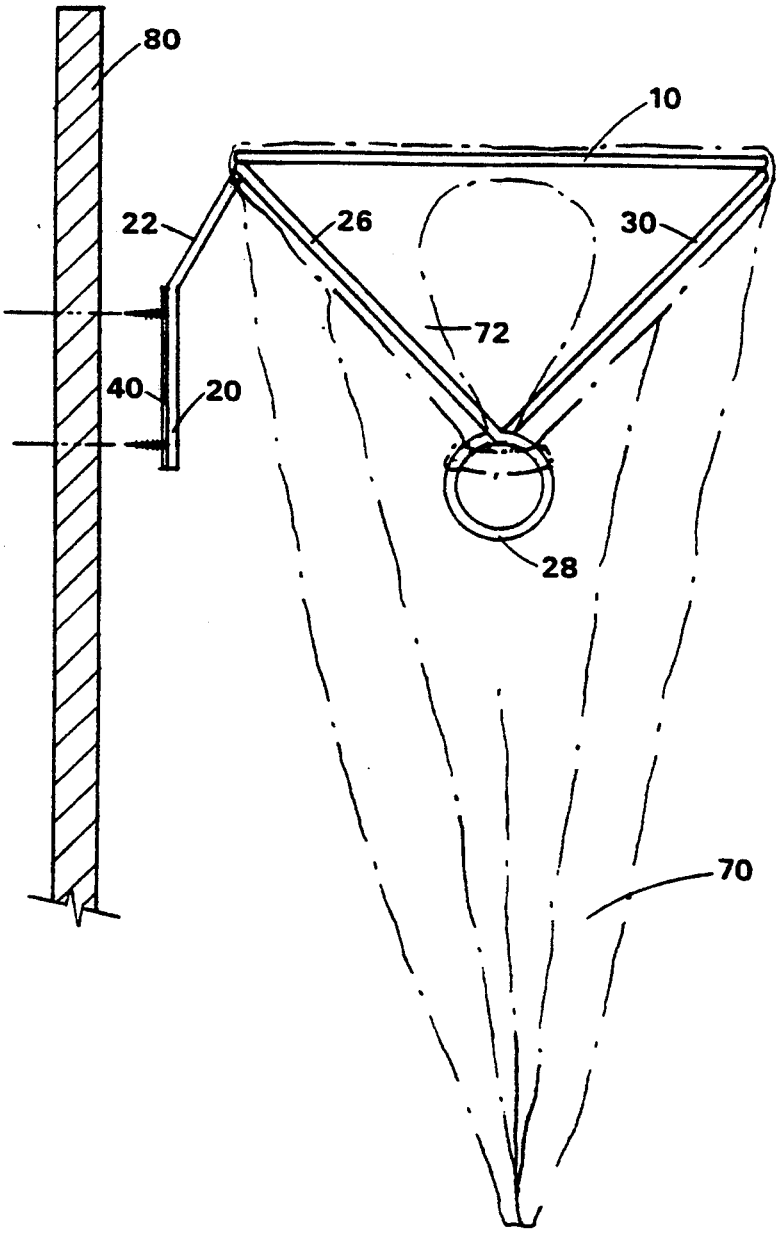
FIG. 4-A

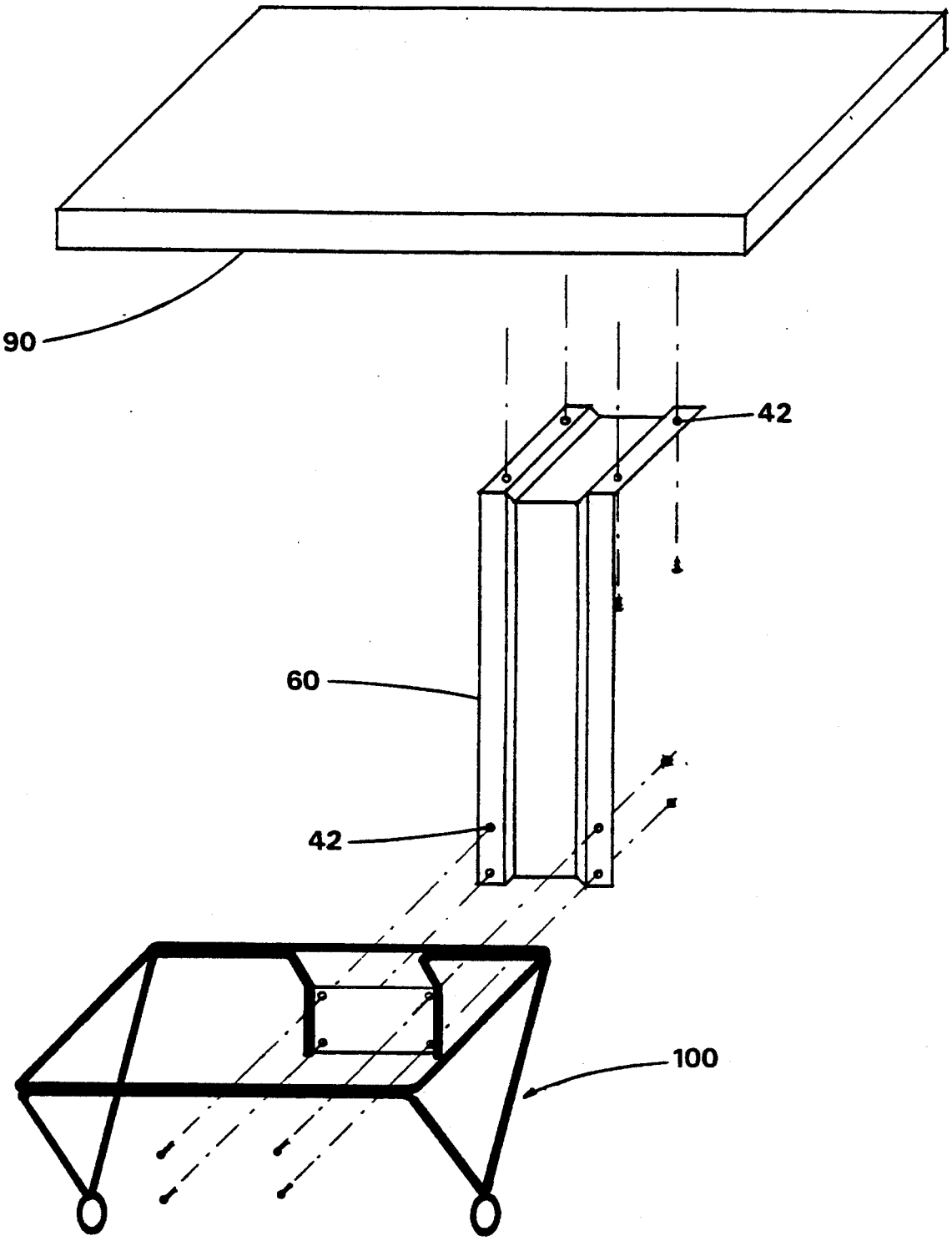
FIG. 4-B

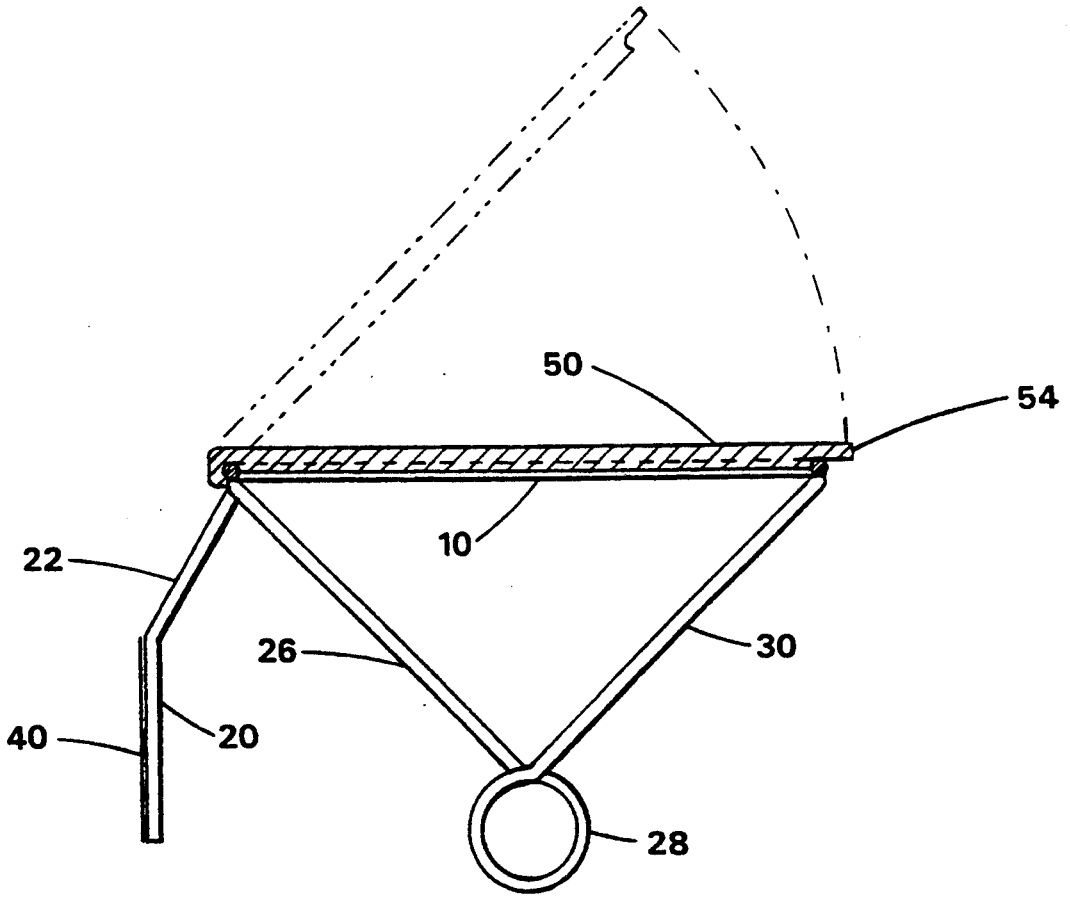
FIG. 5-A

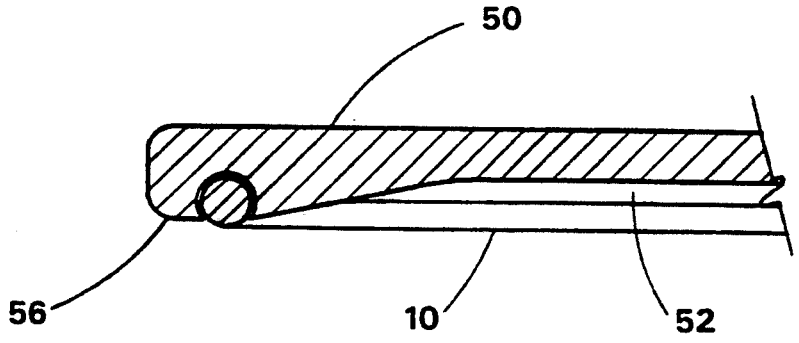
FIG. 5-B

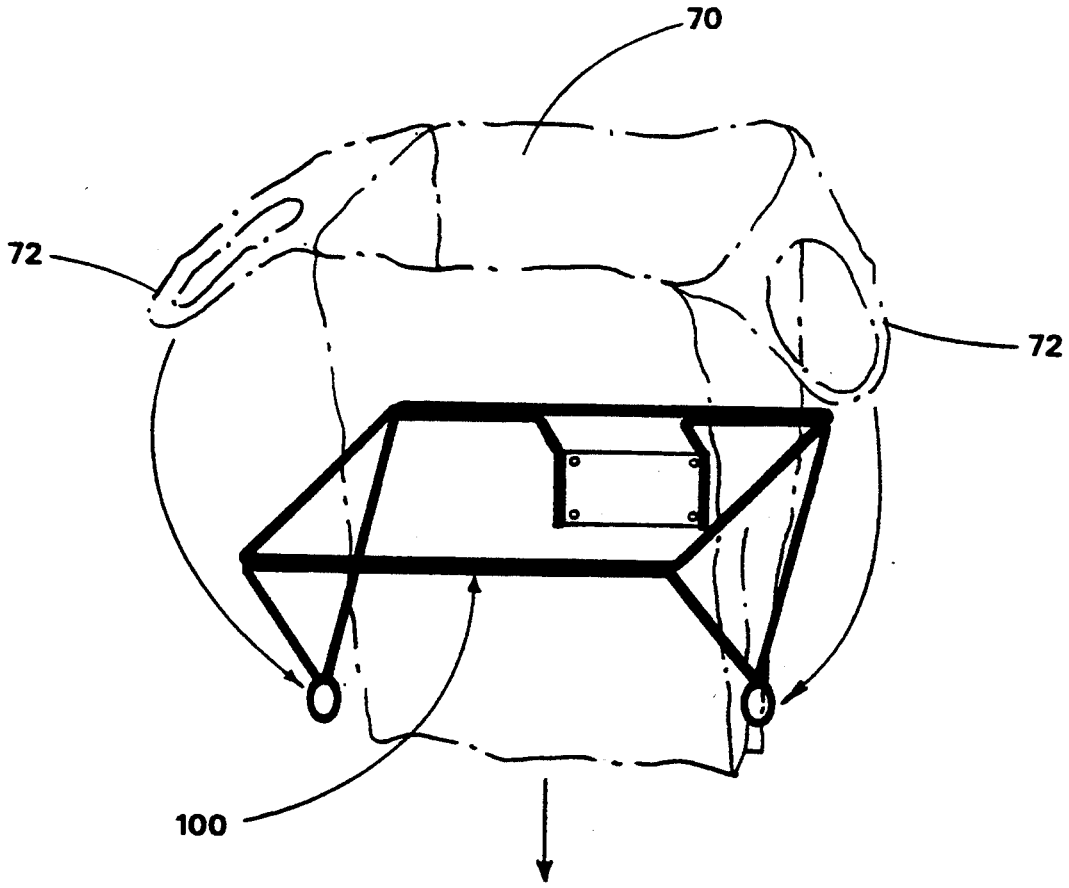
FIG. 6-A

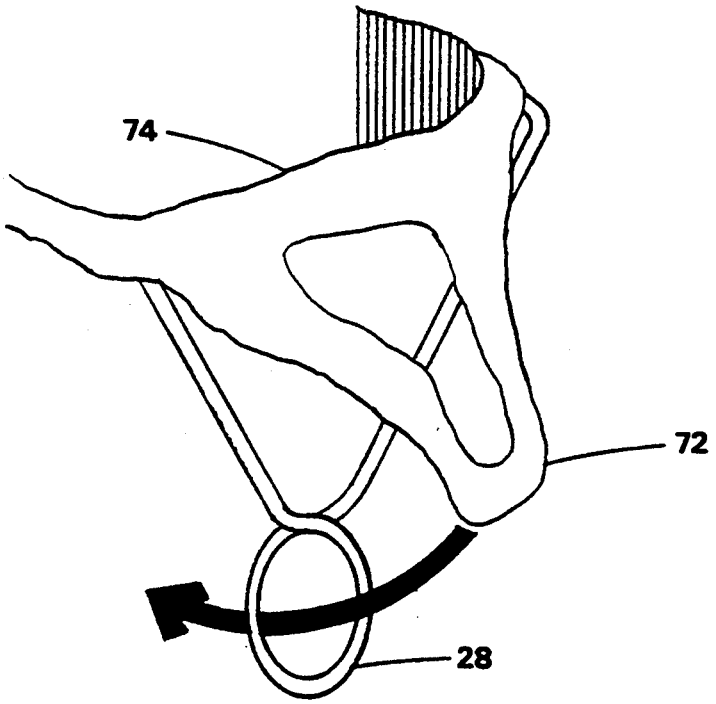
FIG. 6-B

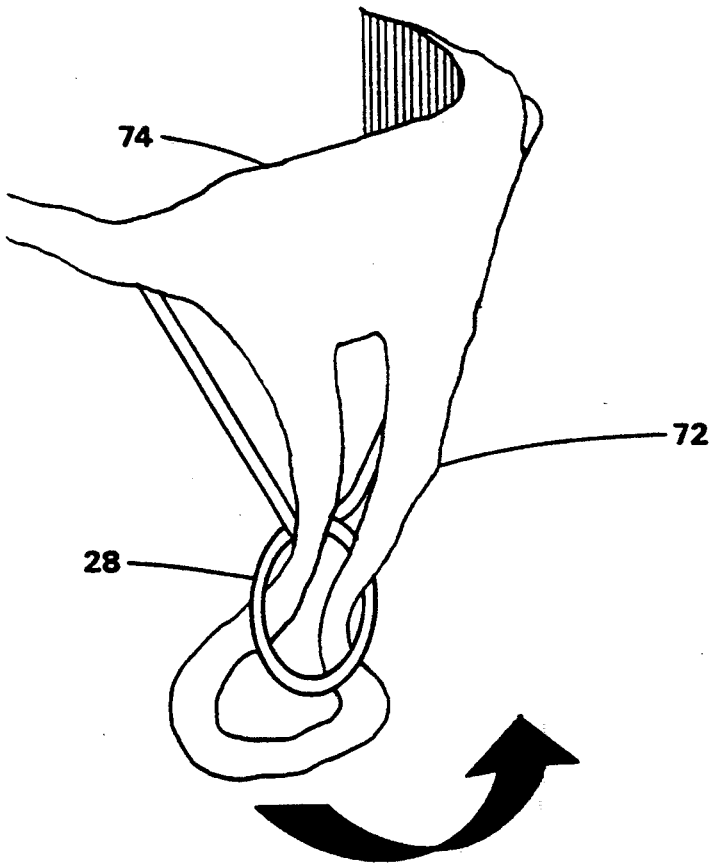
FIG. 6-C

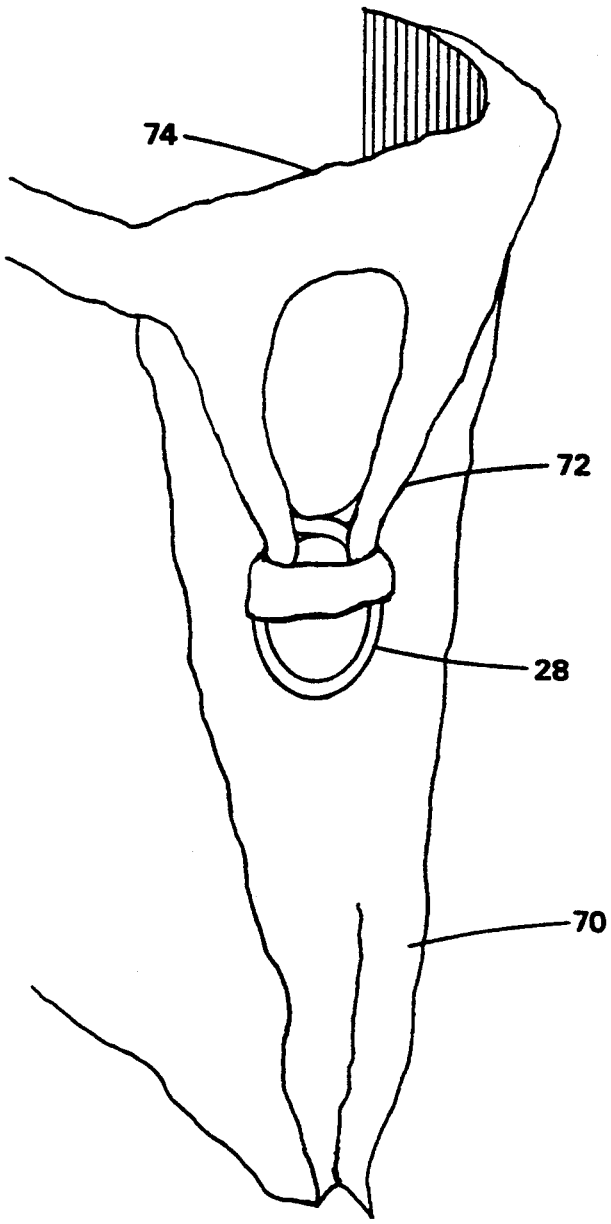
FIG. 6-D

SUPPORT FRAME FOR FLEXIBLE BAGS WITH HANDLES

FIELD OF INVENTION

The present invention relates to a structural frame which supports flexible bags, with integrated handles in an open-mouthed receptacle like manner.

BACKGROUND OF INVENTION

Flexible plastic bags have been a part of nearly everyone's life as a means of dispensing human refuse. There has been a proliferation of different types of trash bags available in the market place to support such a trend. Additionally, in the United States alone hundreds of millions of dollars are spent to produce plastic consumer bags with handles, such as grocery bags. The average household accumulates many of these shopping bags which can be reused for other purposes. With the aid of the present invention these flexible bags can be utilized as a means to discard trash or be used as receptacles for a variety of needs.

Prior Art-Discussion

The prior art include U.S. Pat. No. 4,445,658 to Ferron and U.S. Pat. No. 4,760,983 to McNerney As it will be explained hereafter, these prior art devices do not embody a rack construction having the particular features and advantages of the present invention.

In each of the references cited, means are employed to secure the flexible handles, but such means do not adequately guaranty a securely locked handle. Thus, making it is possible for the handles to accidentally disengage from the securing means.

U.S. Pat. No. 4,444,658 to Ferron discloses numerous appendages which hinder bag removal, thus allowing for the possibility of the bag snagging on the securing means.

In U.S. Pat. No. 4,760,983 to Mc Nerney the frame configuration does not adequately provide support for flexible handle bags as compared to the flexible bags without handles for which the frame is specifically designed. This allows apertures in the flexible handle bags to sag below the support frame, thus allowing odor and refuse to spill from these handle bags. In disengaging the flexible handle bags from the securing means the user must carefully maneuver the bag. Disengaging the handles from the securing means requires pulling the bag forwardly around the securing means, consequently decreasing the depth of the flexible handle bag and rendering it possible for the contents of the bag to spill over the support frame. Therefore, the user can not fill the flexible handle bags to capacity. The bottom support structure hinders the release of over-filled bags or those filled with large objects, requiting the user to pry out such full bags. Additionally, the lid of the invention does not fit tightly over the bag, thus it does not insure a tight seal thereby allowing odor seepage.

OBJECTS OF INVENTION

The first object of this present invention is to provide a structural support frame for plastic shopping bags with handles, thereby enabling recycling of the bags as a receptacle for other uses. Accordingly, several other objects and advantages of this invention are:

1. To provide a support frame for plastic handle bags that is compact in design and is suitable for mounting in convenient locations, such as inside a cupboard door or on the underside of horizontal surfaces like shelves or tables;

2. To provide a support frame which is easy to understand and operate by its straightforward means of installing and removing said bags;

3. To provide a support frame that will securely and easily lock handles of a bag in place as an integral part of the frame, while rendering easy the removal of fully loaded bags;

4. To provide a support frame in which various types of handle bags, with handles at both frontal and lateral locations can be utilized;

5. To provide a support frame with a seal-tight lid having a specially designed recessed perimetrical groove to hinder any odor seepage;

6. To provide a support frame that is sturdy in design and easy to maintain for long term use;

7. To provide a support frame which is an economical and ecological solution to reuse surplus plastic shopping bags as a means to dispense trash, to use as a storage receptacle, and to relieve the need to purchase other plastic bags specifically designed as trash bags to perform the same function.

DRAWING FIGURES

In the drawings, closely related figures have the same number but different alphabetic suffixes.

Figure 1:
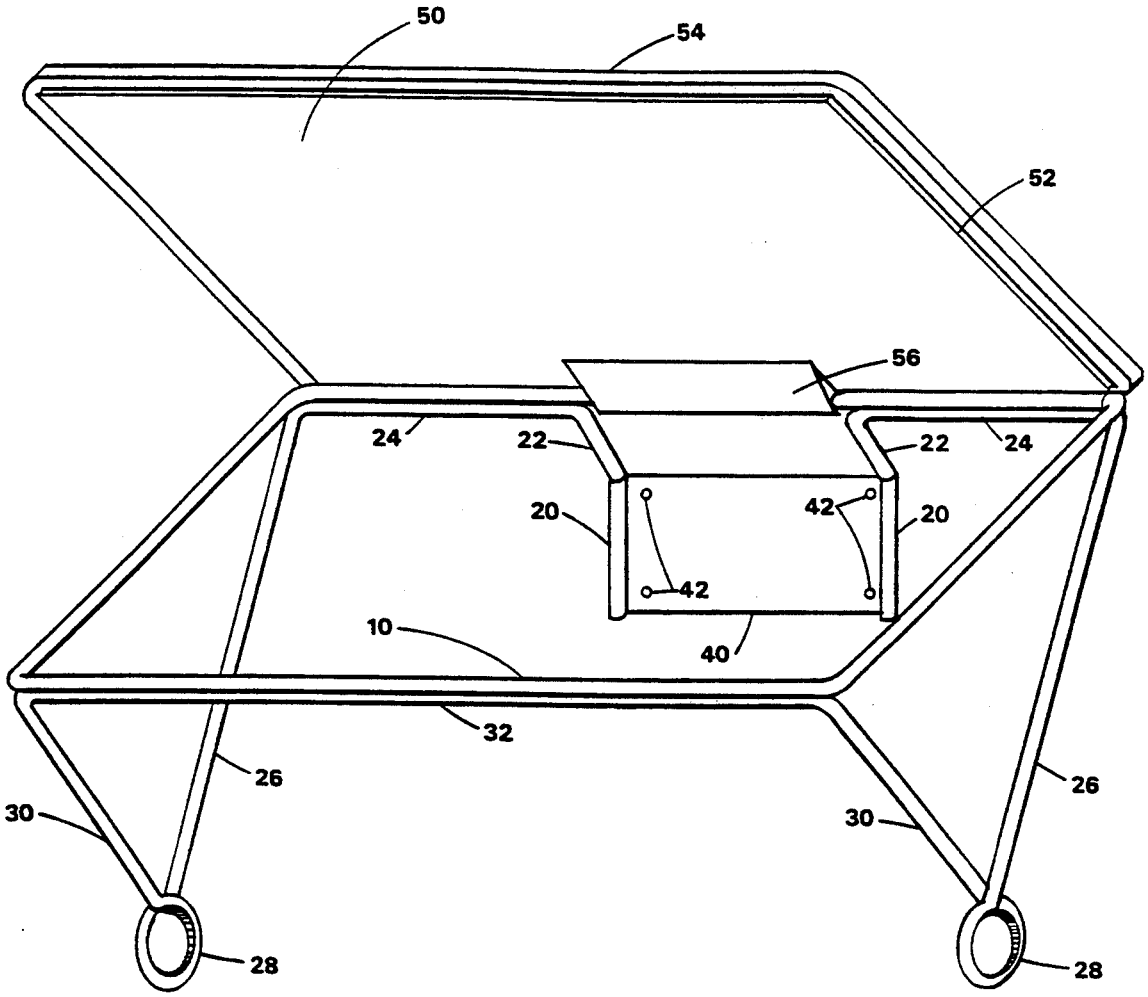
FIG. 1 shows an axonemetric view of the preferred embodiment of present invention.
Figure 2:
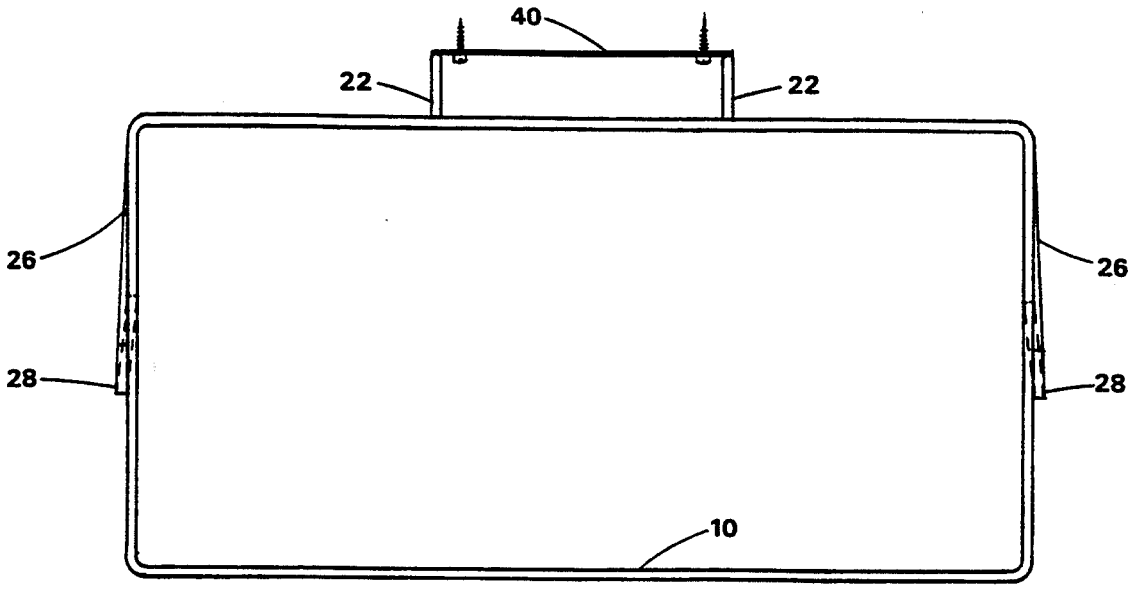
FIG. 2 shows a top view of the invention of FIG. 1.
Figure 3:
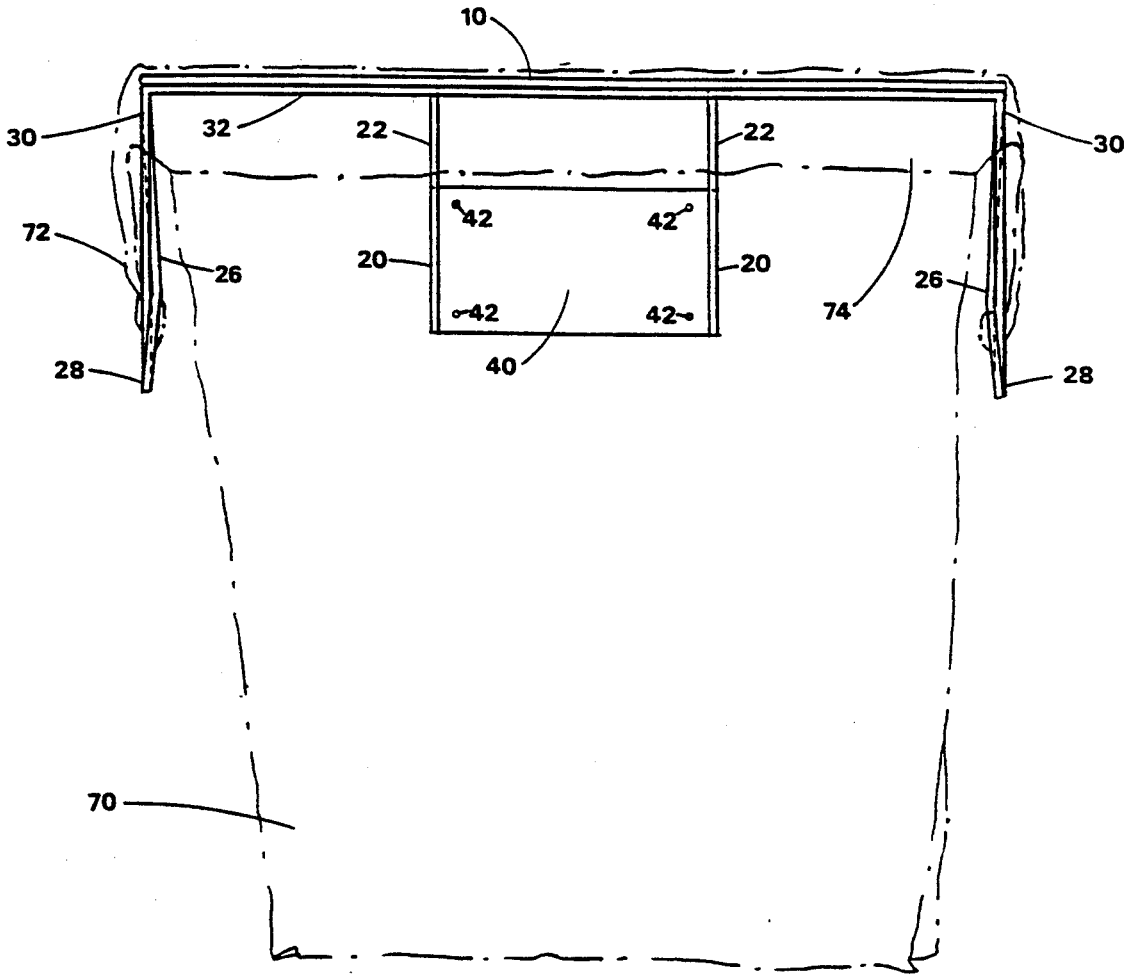
FIG. 3 shows a front view of the invention of FIG. 1.

FIG. 4*a* shows a side view of the invention of FIG. 1 mounted on vertical surface.

FIG. 4*b* shows L-shaped angle mounting device for mounting the invention of FIG. 1 on a horizontal surface.

FIG. 5*a* shows a side view of the invention of FIG. 1 with operation of a lid.

FIG. 5*b* shows a detail view of the hinge mechanism.

FIGS. 6*a*, 6*b*, 6*c* and 6*d* show the installation and removal of a flexible bag from the invention of FIG. 1.

| Reference Numerals in Drawings | |
|---|---|
| 10 Rim | 50 Lid |
| 20 Support Appendage | 52 Groove |
| 22 Spacer | 54 Lip |
| 24 Rear Support Structure | 56 Hinge |
| 26 Rear Lateral Brace | 60 L-shaped Angle |
| 28 Ring Like Member | 70 Flexible Bag |
| 30 Front Lateral Brace | 72 Bag Handles |
| 32 Front Support Structure | 74 Top Edge of Flexible Bags |
| 40 Plate | 80 Vertical Mounting Surface |
| 42 Hole | 90 Horizontal Mounting Surface |
| | 100 Preferred Embodiment of Present Invention. |

DETAILED DESCRIPTION OF CONSTRUCTION

The preferred embodiment of this invention comprises a polygonal support rim 10 adapted to support a flexible bag 70 of the type having a pair of integrally formed flexible bag handles 72 in open mouthed configuration. The invention is preferably made of rigid metal rod which may be anodized, painted, metal plated, or covered with a suitable plastic to resist corrosion. The invention may also be constructed of rigid plastic rods or solid body construction as long as all members are present and the scope of the invention is not altered.

Rim 10 is preferably a continuous horizontal rectangular or polygonal element. Rim 10 is generally rectangular in shape, has at least four sides and longer front and back.

The rear side of rim 10 is supported by and rigidly secured to a pair of space-apart vertical support appendages 20. Each support appendage 20 is formed with a forwardly angled spacer 22 above the upper end of appendage 20. Each spacer 22 is connected to a rear support structure 24. Support structure 24 is parallel to rim 10 along the rear and is affixed to the underside of rim 10. At each rear comer of rim 10, support structure 24 and a rear lateral brace 26 intersect. Lateral brace 26 is forwardly angled in a downward direction originating at the intersection of support structure 24 and lateral brace 26.

Lateral brace 26 terminates at a ring like member 28. Ring like member 28 allows the user to engage bag handle 72 and tensionally lock the handle to member 28.

A front lateral brace 30 is forwardly angled in an upward direction originating at the intersection of ring like member 28 and lateral brace 26. Lateral brace 30 terminates at the front comer of rim 10. A front support structure 32 originates at the front comer of rim 10 and terminates at the opposite front comer. These points are also defined as the intersection point of lateral brace 30 and support structure 32. Support structure 32 is affixed to the underside and runs parallel to the front side of rim 10.

The process explained herein for members 20 to 32 is repeated as stated to produce the opposite side of the invention.

Preferably, a flat mounting plate 40 is secured between support appendages 20. The mounting plate 40 has guide holes 42 at its four comers for mounting screws. Such that the device can be secured or screwed to a vertical mounting surface 80, such as the inner surface of a cabinet door. Alternatively, as shown in FIG. *4b*, a L-shaped angle mounting device 60 may be used to mount the invention to a horizontal mounting surface 90, such as the underside of a table or a shelf.

In order to prevent unpleasant odors from escaping into the surrounding air, a lid 50 is provided. The lid 50 has the same general shape as the rim 10 over which it fits. Lid 50 has a groove 52 perimetrically disposed on the entire underside of lid 50. Groove 52 has a radius which corresponds to that of rim 10 to allow for a fight fit when the lid 50 is securely closed onto the support frame. Lid 50 will also have a lip 54 projecting outwardly from the front side to allow the user to easily grasp the lid for ease of opening. Lid 50 will also have a snap-on hinge 56 having a cavity opposite in form and generally equal in diameter as said rim 10, which is engaged by interlocking said two opposing forms for allowing the lid to be snapped onto rim 10 as best seen in FIG. *5a*.

Operation of Said Invention

To install flexible bag 70 on the present invention, it will be easily understood that the former is simply put into the opening defined by rim 10 such that a top edge 74 of the bag is folded over rim 10.

Bag handles 72 of the bag are each inserted from the outside through ring like member 28, then pulled downwardly around the bottom of the ring like member and up, thus allowing bag handle 72 to be integrally engaged to member 28 as best seen in FIGS. *6a*, *6b*, *6c* and *6d*. Thus, each handle is tensionally locked in tensionally. In this way, flexible bag 70 functions as an integral part of the structural frame, forming an open mouthed receptacle, in open mouthed configuration until it is full and ready to be removed.

It will also be readily understood that the invention allows the full flexible bag 70 to be easily removed, by lowering the bag thorough rim 10 since there is no physical obstruction below the support structure to impede or interfere in said bag removal. At this point, the bag may be conveniently tied closed using bag handles 72.

SUMMARY, RAMIFICATION

Accordingly, the reader will view that the proposed present invention will facilitate reuse of commercial plastic shopping bags with handles. Additionally the invention will provide economical advantages to its user, at the same time allowing the user to participate in recycling waste for other productive uses, which is an environmentally sound practice. All elements of the invention are essential to its function. No element can be taken away without sacrificing its operation. The configuration of the invention can be many, as well as type of material that can be used such as rigid plastic. The embodiment may be solid homogeneous mold injected plastic construction or rigid plastic rod construction; as long as all the functional elements as stated in the claim are present.

We claim:

1. A frame for supporting a flexible bag of the type having a pair of bag handles disposed on opposing sides of the bag adjacent to an opening of the bag, comprising;

A) a rim having a plurality of rim members connected together in a planar configuration and framing an opening;

B) means for providing attachment of the frame to a planar surface;

C) a pair of lateral braces attached to the rim on opposing sides of the opening, both of said braces extending perpendicularly to the planar configuration of the rim; and D) a pair of members forming ring like openings each attached to a respective brace distal from the rim, wherein said bag handles are threaded through and integrally attached to said ring like members.

2. A structural support frame as defined in claim 1, further comprising a lid having perimetrical grooves having a form oppositely corresponding to that of said rim, secured to rear side of said structural frame with said snap on hinge mechanism.

3. A frame for supporting a flexible bag of the type having a pair of bag handles disposed on opposing sides of the bag adjacent to an opening of the bag, comprising:

A) a rim having a plurality of short rim members and long rim members connected together in a generally rectangular planar configuration and framing an opening;

B) a support brace coupled to the rim, comprising a pair of horizontal members each being coupled to a respective one of the long rim members, a pair of vertical members each extending perpendicularly to the planar configuration of the rim, wherein each vertical member connects an end of a first horizontal member to an end of a second horizontal member in the shape of a V and coplanar with one of the short rim members, a pair of members forming ring like openings each attached to a respective vertical member at an apex of the V shape wherein said bag handles are threaded through and integrally connected to said ring like members, whereby said flexible bag and said structural frame become integrally formed and functionas a receptacle; and C) means for providing attachment of the frame and support branch to a vertical or horizontal planar surface.

4. A structural support frame as defined in claim 3, further comprising a lid having perimetrical grooves having a form oppositely corresponding to that of said rim, whereby said flexible bag is sandwiched between two opposingly formed interlocking members, secured to rear side of said structural frame with said snap on hinge mechanism.

* * * * *